US008745950B2

(12) United States Patent
Ito et al.

(10) Patent No.: US 8,745,950 B2
(45) Date of Patent: Jun. 10, 2014

(54) CONSTRUCTION STRUCTURE OF WALL SURFACE

(75) Inventors: Hiroshi Ito, Nagoya (JP); Gou Minami, Ichinomiya (JP)

(73) Assignee: Nichiha Corporation, Nagoya-Shi (JP)

( * ) Notice: Subject to any disclaimer, the term of this patent is extended or adjusted under 35 U.S.C. 154(b) by 473 days.

(21) Appl. No.: 13/024,654

(22) Filed: Feb. 10, 2011

(65) Prior Publication Data

US 2012/0204511 A1 Aug. 16, 2012

(51) Int. Cl.
*E04C 2/38* (2006.01)

(52) U.S. Cl.
USPC ..... 52/578; 52/311.1; 52/464; 52/582.1; 52/764

(58) Field of Classification Search
USPC ..... 52/764, 235, 311.1, 461, 463, 464, 467, 52/468, 506.05, 512, 513, 772, 578, 579, 52/582.1
See application file for complete search history.

(56) References Cited

U.S. PATENT DOCUMENTS 982,015 A * 1/1911 Olsen et al. ..... 52/308
2,065,920 A * 12/1936 Clark ..... 52/275
2,075,773 A * 3/1937 Vass ..... 52/592.1
2,137,896 A * 11/1938 Marsh ..... 52/314
2,277,792 A * 3/1942 Small ..... 52/506.09
2,897,620 A * 8/1959 Fitzgerald ..... 52/796.1
3,000,144 A * 9/1961 Kitson ..... 52/309.11
3,124,222 A * 3/1964 Mote ..... 52/463
3,339,334 A * 9/1967 Rowan et al. ..... 52/204.67
3,471,985 A * 10/1969 Lindelow ..... 52/204.591
3,609,934 A * 10/1971 O'Carroll ..... 52/461
3,630,817 A * 12/1971 Winkowski ..... 428/164
3,667,174 A * 6/1972 Arnett ..... 52/100
4,011,698 A * 3/1977 Sklaar ..... 52/98
4,033,084 A * 7/1977 Shiflet ..... 52/396.04
4,189,881 A * 2/1980 Hawley ..... 52/91.3
4,254,178 A * 3/1981 Church et al. ..... 428/158
4,373,312 A * 2/1983 Kim ..... 52/309.9
4,413,457 A * 11/1983 Lahm et al. ..... 52/314

(Continued)

FOREIGN PATENT DOCUMENTS

AU 2011100232 A4 * 3/2011
JP 2001003542 A * 1/2001

(Continued)

OTHER PUBLICATIONS

Machine Translation of JP 2001-003542 A (7 pages).*

*Primary Examiner* — Basil Katcheves
*Assistant Examiner* — Rodney Mintz
(74) *Attorney, Agent, or Firm* — Birch, Stewart, Kolasch & Birch, LLP

(57) ABSTRACT

A construction structure of wall surface includes: a hat joiner; and a building board. The hat joiner has a fixing plate portion and a design portion, and the building board has a design portion extending linearly on a surface. A joint at which the design portion of the hat joiner constitutes a design surface, and a design pattern at which the design portion of the building board constitutes a design surface, are formed in a same direction, by arranging the building board in plurality to left and right, or above and below, of the design portion of the hat joiner. A width of the joint at the design portion of the hat joiner is the same as a width of each of the design portions on the surface of each of the building boards.

6 Claims, 11 Drawing Sheets

(56) References Cited

U.S. PATENT DOCUMENTS

| | | | | | |
|---|---|---|---|---|---|
| 4,455,794 | A | * | 6/1984 | MacKinnon et al. | 52/98 |
| H129 | H | * | 9/1986 | Hansen | 89/36.04 |
| 4,617,772 | A | * | 10/1986 | Hassell | 52/461 |
| 4,631,097 | A | * | 12/1986 | Kossuth | 156/44 |
| 4,644,719 | A | * | 2/1987 | Salazar | 52/384 |
| 4,671,038 | A | * | 6/1987 | Porter | 52/586.1 |
| 4,724,638 | A | * | 2/1988 | Bezborodko | 52/506.05 |
| 4,825,612 | A | * | 5/1989 | Tupman | 52/371 |
| 4,918,879 | A | * | 4/1990 | Bodurow et al. | 52/36.6 |
| 5,185,971 | A | * | 2/1993 | Johnson, Jr. | 52/36.6 |
| 5,638,653 | A | * | 6/1997 | Rossi | 52/511 |
| 5,694,727 | A | * | 12/1997 | Dobija | 52/506.01 |
| 5,725,940 | A | * | 3/1998 | Sakai et al. | 428/318.6 |
| 5,918,437 | A | * | 7/1999 | Dobija | 52/506.01 |
| 5,924,256 | A | * | 7/1999 | Ito | 52/481.1 |
| 6,018,924 | A | * | 2/2000 | Tamlyn | 52/716.8 |
| 6,170,223 | B1 | * | 1/2001 | Kurose | 52/763 |
| 6,230,469 | B1 | * | 5/2001 | Santa Cruz et al. | 52/745.2 |
| 6,289,646 | B1 | * | 9/2001 | Watanabe | 52/506.01 |
| 6,360,510 | B1 | * | 3/2002 | Woodrum et al. | 52/481.1 |
| 6,374,561 | B1 | * | 4/2002 | Ishiko | 52/506.01 |
| 6,427,405 | B1 | * | 8/2002 | Moriya et al. | 52/396.04 |
| 6,430,883 | B1 | * | 8/2002 | Paz et al. | 52/235 |
| 6,430,885 | B1 | * | 8/2002 | Ito | 52/483.1 |
| 6,460,311 | B1 | * | 10/2002 | Ito | 52/489.1 |
| 6,505,448 | B2 | * | 1/2003 | Ito | 52/474 |
| 6,526,715 | B2 | * | 3/2003 | Kaneko et al. | 52/483.1 |
| 6,609,341 | B2 | * | 8/2003 | Maylon et al. | 52/367 |
| 6,612,090 | B1 | * | 9/2003 | Corden | 52/762 |
| 6,615,560 | B2 | * | 9/2003 | Ito | 52/506.06 |
| 6,631,599 | B1 | * | 10/2003 | Takagi | 52/579 |
| 6,637,170 | B2 | * | 10/2003 | Ito | 52/506.06 |
| 6,688,060 | B2 | * | 2/2004 | Sawada | 52/309.13 |
| 6,688,073 | B2 | * | 2/2004 | VanderWerf et al. | 52/745.09 |
| 6,729,097 | B2 | * | 5/2004 | Patel et al. | 52/665 |
| 6,748,709 | B1 | * | 6/2004 | Sherman et al. | 52/235 |
| 6,857,248 | B2 | * | 2/2005 | Ouellet et al. | 52/745.06 |
| 6,862,855 | B1 | * | 3/2005 | Milum et al. | 52/384 |
| 6,895,721 | B2 | * | 5/2005 | Watanabe et al. | 52/506.05 |
| 6,988,344 | B1 | * | 1/2006 | Krueger | 52/464 |
| 7,073,302 | B2 | * | 7/2006 | Burg | 52/481.1 |
| 7,104,018 | B2 | * | 9/2006 | Romes et al. | 52/405.1 |
| 7,373,762 | B2 | * | 5/2008 | Hubbard | 52/281 |
| 7,454,866 | B2 | * | 11/2008 | Maurer | 52/235 |
| 7,543,419 | B2 | * | 6/2009 | Rue | 52/630 |
| 7,703,251 | B2 | * | 4/2010 | Roh | 52/309.9 |
| 7,743,575 | B2 | * | 6/2010 | Ito | 52/582.1 |
| 7,810,289 | B2 | * | 10/2010 | Montgomery | 52/235 |
| 7,926,230 | B2 | * | 4/2011 | Yoshida et al. | 52/235 |
| 8,024,902 | B2 | * | 9/2011 | Wedi | 52/395 |
| 8,033,065 | B2 | * | 10/2011 | Paetkau et al. | 52/220.1 |
| 8,250,832 | B2 | * | 8/2012 | Sjoberg | 52/747.1 |
| 8,281,551 | B2 | * | 10/2012 | Leek et al. | 52/798.1 |
| 8,322,103 | B1 | * | 12/2012 | Kownacki | 52/506.05 |
| 8,429,868 | B2 | * | 4/2013 | Minami | 52/506.05 |
| 8,468,767 | B1 | * | 6/2013 | McBride | 52/586.2 |
| D689,199 | S | * | 9/2013 | Elizarraras et al. | D25/55 |
| D689,200 | S | * | 9/2013 | Elizarraras et al. | D25/55 |
| 2001/0011443 | A1 | * | 8/2001 | Watanabe et al. | 52/506.05 |
| 2001/0032426 | A1 | * | 10/2001 | VanderWerf et al. | 52/284 |
| 2002/0023398 | A1 | * | 2/2002 | Ito | 52/220.1 |
| 2002/0032999 | A1 | * | 3/2002 | Ito | 52/474 |
| 2002/0046546 | A1 | * | 4/2002 | Ito | 52/802.11 |
| 2002/0174622 | A1 | * | 11/2002 | Ouellet et al. | 52/745.06 |
| 2003/0182889 | A1 | * | 10/2003 | Takagi | 52/579 |
| 2004/0010998 | A1 | * | 1/2004 | Turco | 52/762 |
| 2005/0204697 | A1 | * | 9/2005 | Rue | 52/782.1 |
| 2005/0204699 | A1 | * | 9/2005 | Rue | 52/794.1 |
| 2006/0010802 | A1 | * | 1/2006 | Sanborn | 52/311.1 |
| 2007/0256386 | A1 | * | 11/2007 | Ito | 52/582.1 |
| 2008/0190061 | A1 | * | 8/2008 | Roh | 52/309.7 |
| 2008/0296451 | A1 | * | 12/2008 | Yoshida et al. | 248/220.1 |
| 2009/0084053 | A1 | * | 4/2009 | Hikai | 52/284 |
| 2010/0095613 | A1 | * | 4/2010 | Paetkau et al. | 52/220.1 |
| 2011/0005147 | A1 | * | 1/2011 | Zaveri et al. | 52/144 |
| 2011/0197544 | A1 | * | 8/2011 | Leek et al. | 52/764 |
| 2011/0219716 | A1 | * | 9/2011 | Chen | 52/316 |
| 2012/0096799 | A1 | * | 4/2012 | Wright | 52/578 |
| 2012/0247049 | A1 | * | 10/2012 | Wagner et al. | 52/506.05 |
| 2012/0247052 | A1 | * | 10/2012 | Wagner et al. | 52/582.1 |
| 2012/0304572 | A1 | * | 12/2012 | Aboukhalil | 52/489.1 |
| 2013/0000238 | A1 | * | 1/2013 | Minami | 52/483.1 |

FOREIGN PATENT DOCUMENTS

| | | | | |
|---|---|---|---|---|
| JP | 2003-328529 | A | | 11/2003 |
| JP | 2003-343024 | A | | 12/2003 |
| JP | 2006125091 | A | * | 5/2006 |

* cited by examiner

CONSTRUCTION STRUCTURE OF WALL SURFACE

BACKGROUND OF THE INVENTION

1. Field of the Invention

The present invention relates to a construction structure of wall surface comprised in an inner wall or an outer wall of a building.

2. Description of the Related Art

Conventionally, outer and inner walls of buildings are constructed through fitting of a plurality of building boards onto a building frame. A sealing material is provided for joining the building boards, for countering dimensional changes of the building boards over time, and for waterproofing the building.

For instance, Japanese Patent Application Publication No. 2003-343024 discloses the feature of providing a hat joiner, having a linear projection, between the end faces of adjacent external facing members, and forming a joint by providing a sealing material at a portion formed between the front face of the linear projection and the end face of the external facing members.

However, the joint formed by providing the sealing material is likely to be noticeable, which is problematic. Also, sealing deteriorates over time, and performance in terms of durability, waterproofness and so forth becomes impaired, which is likewise problematic. Further, the passage of time gives rise to discoloration and impaired appearance, and makes it necessary to repair and/or renew the deteriorated sealing material.

Accordingly, Japanese Patent Application Publication No. 2003-328529 discloses a vertical joint structure wherein siding panels are arranged on a joiner to which a waterproof material is attached, such that the end portions of the siding panels are butt-joined to each other.

No sealing material is required in the structure of Japanese Patent Application Publication No. 2003-328529, and hence the problem of noticeable joints that form by providing a sealing material does not occur, nor is repair or renewal necessary upon deterioration of the sealing over time. However, it is difficult to manufacture the siding panels with good enough precision so as to preclude gaps from appearing upon butt-joining to other siding panels, and the joining portions between siding panels are readily noticeable. Also, the dimensions of the siding panels change over time, and hence gaps appear at the joining portions between siding panels, or small gaps become larger, among other problems.

SUMMARY OF THE INVENTION

The present invention provides a construction structure of wall surface that has no sealing material and in which a joining portion between building boards is inconspicuous.

The present invention provides a construction structure of wall surface.

A construction structure of wall surface includes: a hat joiner; and a building board. The hat joiner has a fixing plate portion and a design portion, and the building board has a design portion extending linearly on a surface. A joint at which the design portion of the hat joiner constitutes a design surface, and a joint at which the design portion of the building board constitutes a design surface, are formed in a same direction, by arranging the building board in plurality to left and right, or above and below, of the design portion of the hat joiner. In the present invention, a width of the joint at the design portion of the hat joiner is the same as a width of each of the design portions on the surface of each of the building boards. Alternatively, a color of the design portion of the hat joiner is the same as a color of each of the design portions of each of the building boards. Therefore, a joint at which the design portion of the hat joiner constitutes a design surface cannot be readily distinguished from the design portion of the surface of the building boards, and thus the joint is inconspicuous. Also, no sealing material is provided, and hence the problem of deterioration of the sealing material over time does not occur, which renders unnecessary repairs or renewal associated with deterioration. The building boards are disposed with a gap in between, and hence dimensional changes of the building boards are hardly noticeable, and pose no problem.

In the construction structure of wall surface of the present invention, a top section of the design portion of the hat joiner may be disposed flush at the same height as top sections of surfaces of adjacent building boards, or may be disposed higher than surfaces of adjacent building boards. Preferably, the top section of the design portion of the hat joiner is disposed higher than the surfaces of adjacent building boards, since unevenness among the building boards becomes inconspicuous in that case. That is, unevenness occurring between building boards becomes inconspicuous, even if the thicknesses of building boards that are adjacent across the hat joiner are dissimilar, by disposing the top section of the design portion of the hat joiner at a higher position.

Accordingly, the top section of the design portion of the hat joiner may be disposed lower than surfaces of adjacent building boards. In this case as well, unevenness between building boards becomes hardly noticeable.

The design portions of the building boards may be formed by coating, or may be formed by projections and/or recesses, or by a combination of the foregoing.

Also, an end portion of surface of the building board may be chamfered at a joint comprising the design portion of the hat joiner and the building board. In this case, preferably, a shape identical to the chamfer of the end portion of surface of the building board is provided in the design portions of the building boards, in a same direction as that of the chamfer, since, as a result, a joint at which the design portion of the hat joiner constitutes a design surface cannot be readily distinguished from each of the design portions on the surface of each of the building boards, and thus the joint is inconspicuous.

The present invention allows providing a construction structure of wall surface that has no sealing material and in which a joining portion between building boards is inconspicuous.

DESCRIPTION OF THE PREFERRED EMBODIMENTS

The present invention will be explained in detail below with reference to accompanying drawings.

Figure 1:
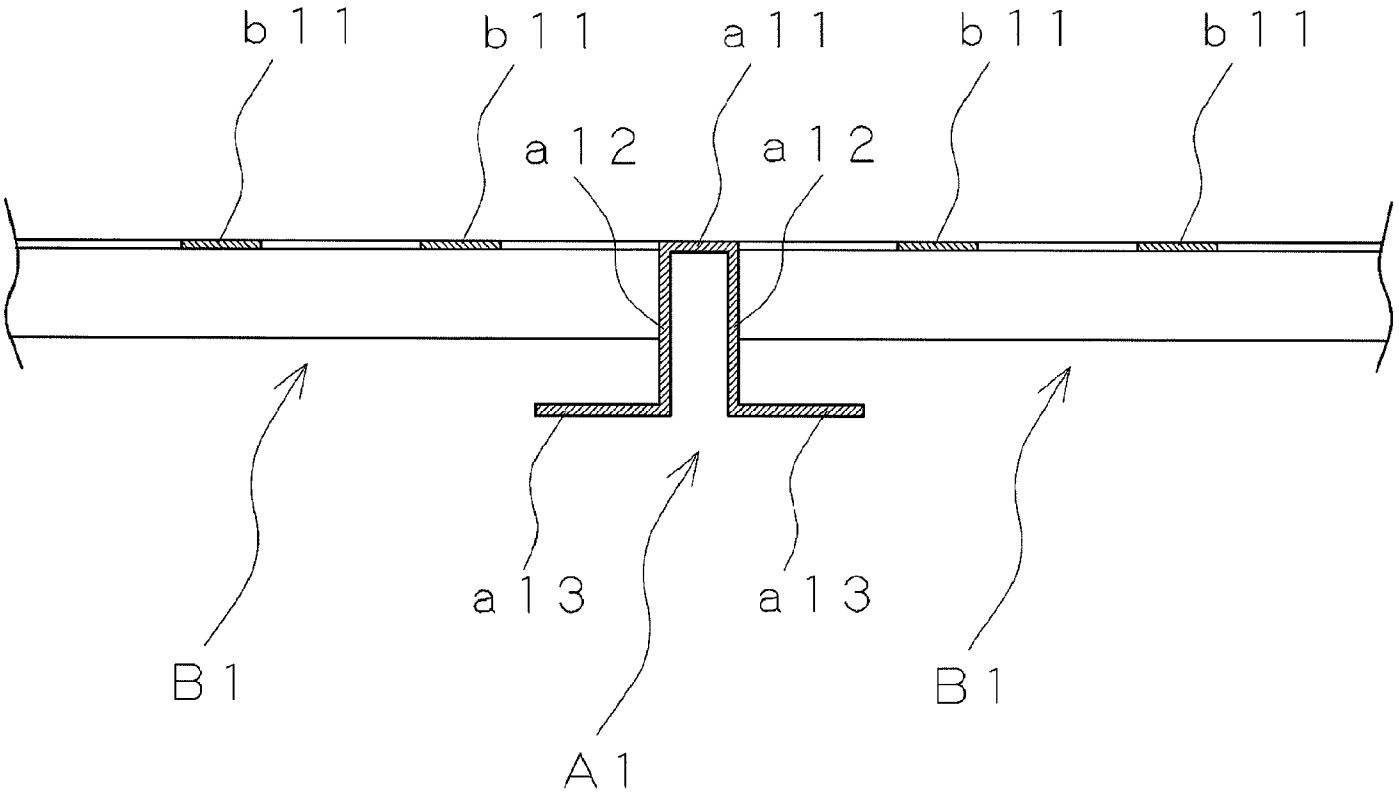
FIG. 1 is a diagram of an embodiment of a construction structure of wall surface according to the present invention, viewed from above.
Figure 2:
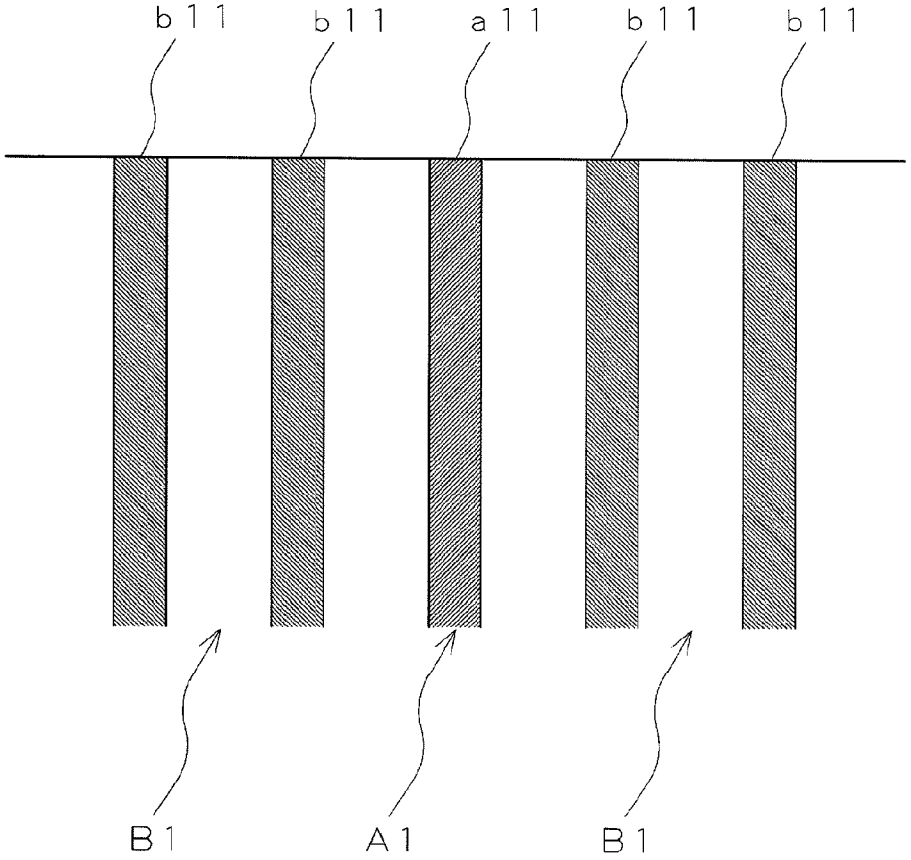
FIG. 2 is a diagram of the construction structure of wall surface illustrated in FIG. 1 viewed from the front.
Figure 3:
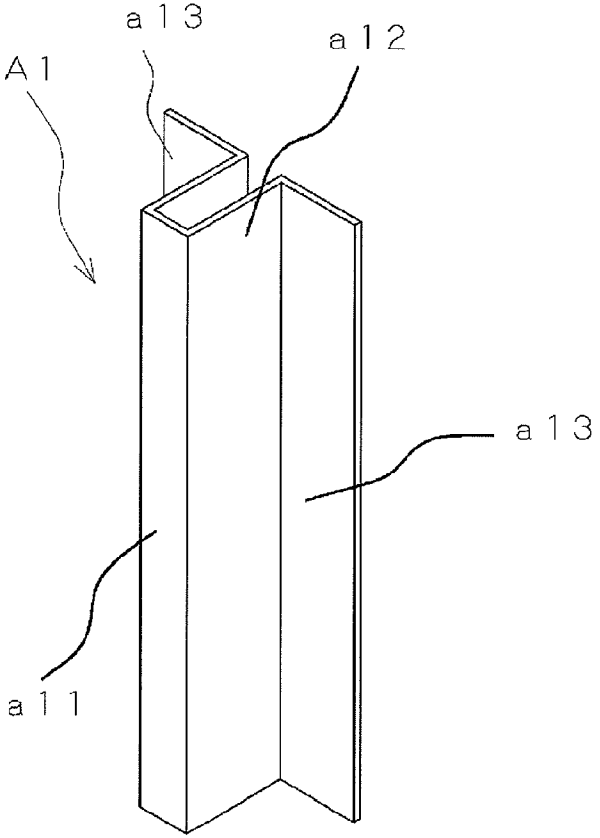
FIG. 3 is a perspective-view diagram of a hat joiner of the construction structure of wall surface illustrated in FIGS. 1 and 2.

FIGS. 1 and 2 are diagrams, viewed from above and from the front, of an embodiment of a construction structure of wall surface according to the present invention. FIG. 3 is a perspective-view diagram of a hat joiner of the construction structure of wall surface illustrated in FIGS. 1 and 2.

The construction structure of wall surface illustrated in FIGS. 1 and 2 comprises a hat joiner A1 and building boards B1.

The hat joiner A1 comprises a design portion a11, connecting portions a12 and fixing plate portions a13, and is an elongated member as illustrated in FIG. 3. The design portion a11 is the most frontward-protruding portion of the hat joiner A1. The connecting portions a12, a12 extend backwards from both ends, left and right, of the design portion a11, and the fixing plate portions a13, a13 extend each horizontally towards the right and left, from respective connecting portions a12, a12. On the surface of the building boards B1 there is provided a plurality of coating films b11, as a design portion, so as to traverse vertically the board up and down. The horizontal width of the coating films b11 is the same as the horizontal width of the design portion a11 of the hat joiner A1. The color of the design portion a11 of the hat joiner A1 is also the same as that of the coating films b11.

In the construction structure of wall surface illustrated in FIGS. 1 and 2, two building boards B1, B1 are fixed, left and right, to the hat joiner A1 that is fixed to a building frame (not shown) in a state where the rear faces of the fixing plate portions a13 abut the surface of the building frame. The two building boards B1, B1 are fixed so as to be several millimeters spaced apart from the fixing plate portions a13, a13 of the hat joiner A1, in order to provide a ventilation layer on the rear face side of the building boards B1, B1. When the construction structure of wall surface is viewed from the front, a design pattern is formed by a design portion of the coating films b11 of the building boards B1, and by the design portion a11 of the hat joiner A1, as illustrated in FIG. 2. However, the horizontal width and the color of the coating films b11 are the same as those of the design portion a11 of the hat joiner A1, and the coating films b11 are parallel to the design portion a11. Therefore, the mutual joints cannot be readily distinguished, and the joining portion between building boards B1, B1 is inconspicuous. Since no sealing material is present at the joining portion between the building boards B1, B1, there occurs no deterioration of the sealing material over time. This renders unnecessary repairs or renewal. The design portion a11 of the hat joiner A1 is disposed at the same height as the surface of the building boards B1, B1, and hence the joining portion between the building boards B1, B1 is hardly noticeable.

Figure 4:
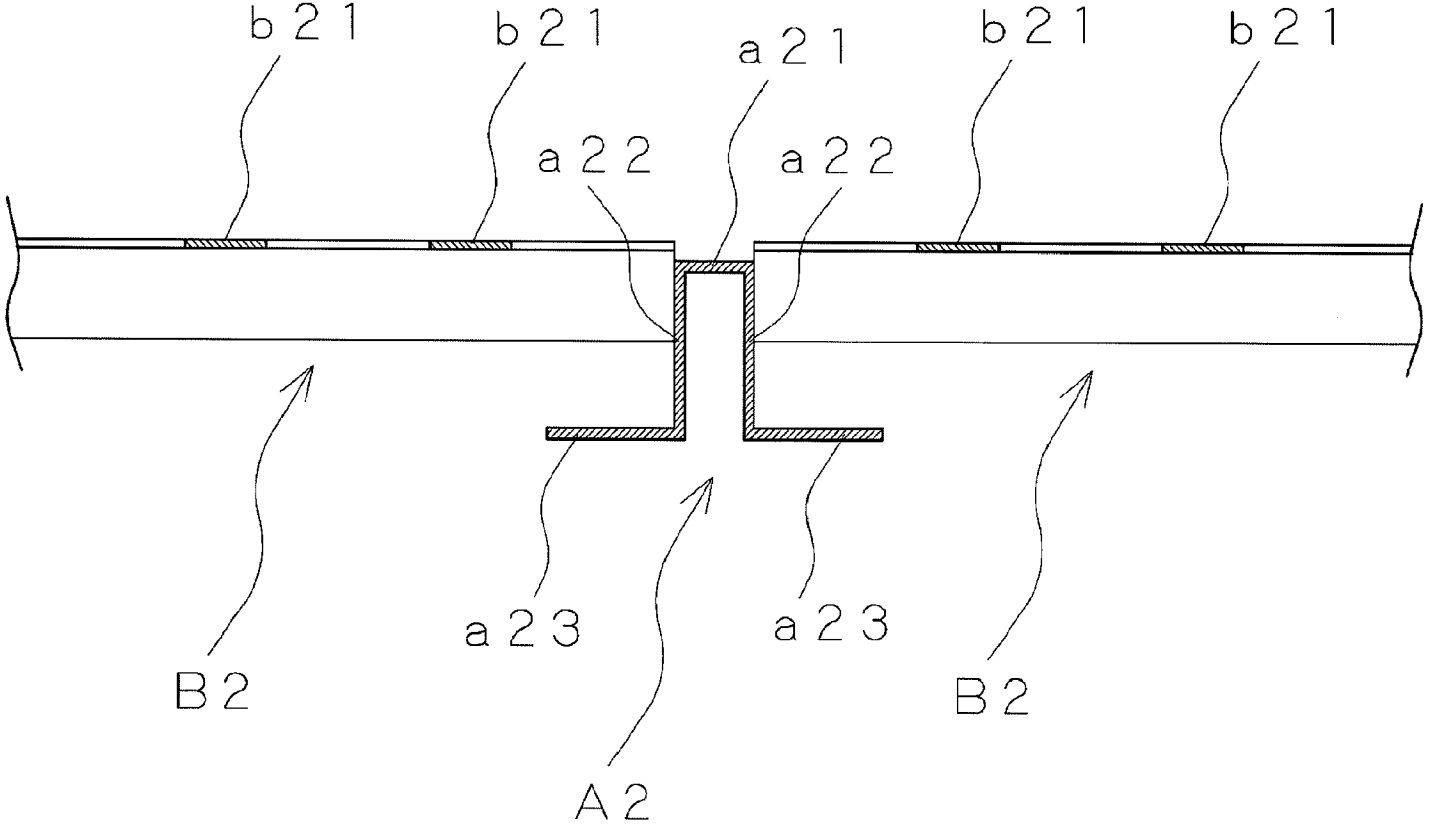
FIG. 4 is a diagram of another embodiment of the construction structure of wall surface according to the present invention, viewed from above.

FIG. 4 is a diagram of another embodiment of the construction structure of wall surface according to the present invention, viewed from above.

The construction structure of wall surface illustrated in FIG. 4 comprises a hat joiner A2 and building boards B2. The hat joiner A2 is identical to the hat joiner A1 of FIG. 3, and comprises a design portion a21, connecting portions a22 and fixing plate portions a23. The building boards B2 are identical to the building boards B1 illustrated in FIGS. 1 and 2, and have a plurality of coating films b21, as a design portion, on the surface. In the construction structure of wall surface illustrated in FIG. 4, however, the positions of the surface of the building boards B2 and of the hat joiner A2 are different from those in the construction structure of wall surface illustrated in FIGS. 1 and 2. In the construction structure of wall surface illustrated in FIG. 4, the position of the design portion a21 of the hat joiner A2 is lower than the surface of the building boards B2, B2. However, the horizontal width and color of the coating films b21 in the present the construction structure of wall surface are the same as the horizontal width and color of the design portion a21 of the hat joiner A2, and the coating films b21 are parallel to the design portion a21. Therefore, the mutual joints cannot be readily distinguished, and the joining portion between building boards B2, B2 is inconspicuous. Since no sealing material is present at the joining portion between the building boards B2, B2, there occurs no deterioration of the sealing material over time. This renders unnecessary repairs or renewal. The position of the design portion a21 of the hat joiner A2 is lower than the surface of the building boards B2, B2, and hence any unevenness that may occur between the building boards B2, B2 becomes inconspicuous.

Figure 5:
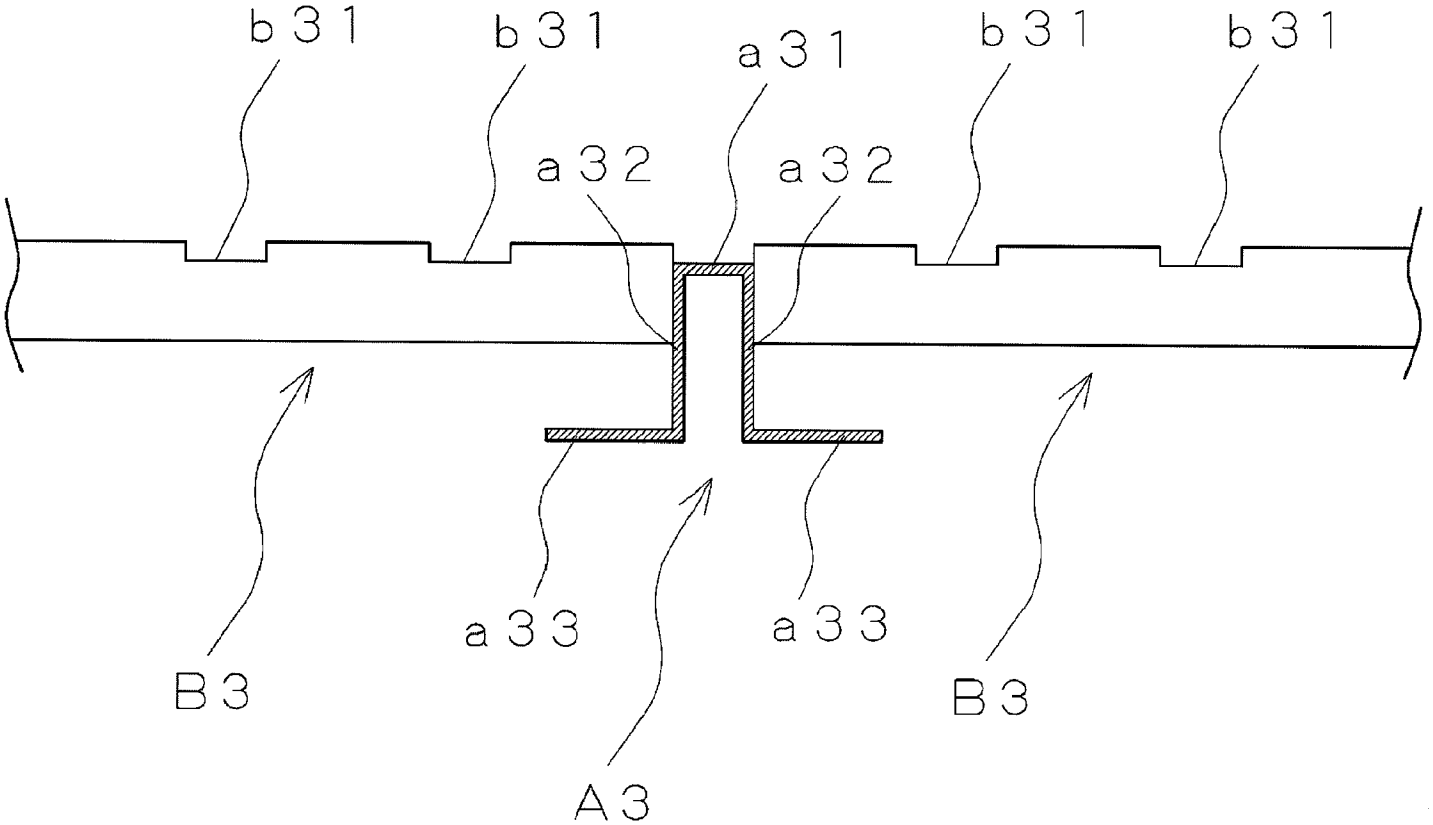
FIG. 5 is a diagram of yet another embodiment of the construction structure of wall surface according to the present invention, viewed from above.

FIG. 5 is a diagram of yet another embodiment of the construction structure of wall surface according to the present invention, viewed from above.

The construction structure of wall surface illustrated in FIG. 5 comprises a hat joiner A3 and building boards B3. The hat joiner A3 is identical to the hat joiner A1 of FIG. 3, and comprises a design portion a31, connecting portions a32 and fixing plate portions a33. However, the building boards B3 are different from the building boards B1 of FIGS. 1 and 2 in that now the design portion is formed by recesses b31. The recesses b31 are provided as a plurality thereof in the surface of the building boards B3, so as to traverse vertically the board up and down. The horizontal width of the recesses b31 is the same as the horizontal width of the design portion a31 of the hat joiner A3. In the construction structure of wall surface illustrated in FIG. 5, the positions of the surface of the building boards B3 and of the hat joiner A3 are different from those in the construction structure of wall surface illustrated in FIGS. 1 and 2. In the construction structure of wall surface illustrated in FIG. 5, the height of the surface of the design portion a31 of the hat joiner A3 is the same as the height of the surface of the recesses b31 of the building boards B3, B3. As a result, the joining portion between the building boards B3, B3 is hardly noticeable also in the construction structure of wall surface illustrated in FIG. 5. In this construction structure of wall surface as well, the horizontal width of the recesses b31 is the same as the horizontal width of the design portion a31 of the hat joiner A3. Therefore, the mutual joints cannot be readily distinguished, and the joining portion between building boards B3, B3 is inconspicuous. Since no sealing material is present at the joining portion between the building boards B3, B3, there occurs no deterioration of the sealing material over time. This renders unnecessary repairs or renewal.

Figure 6:
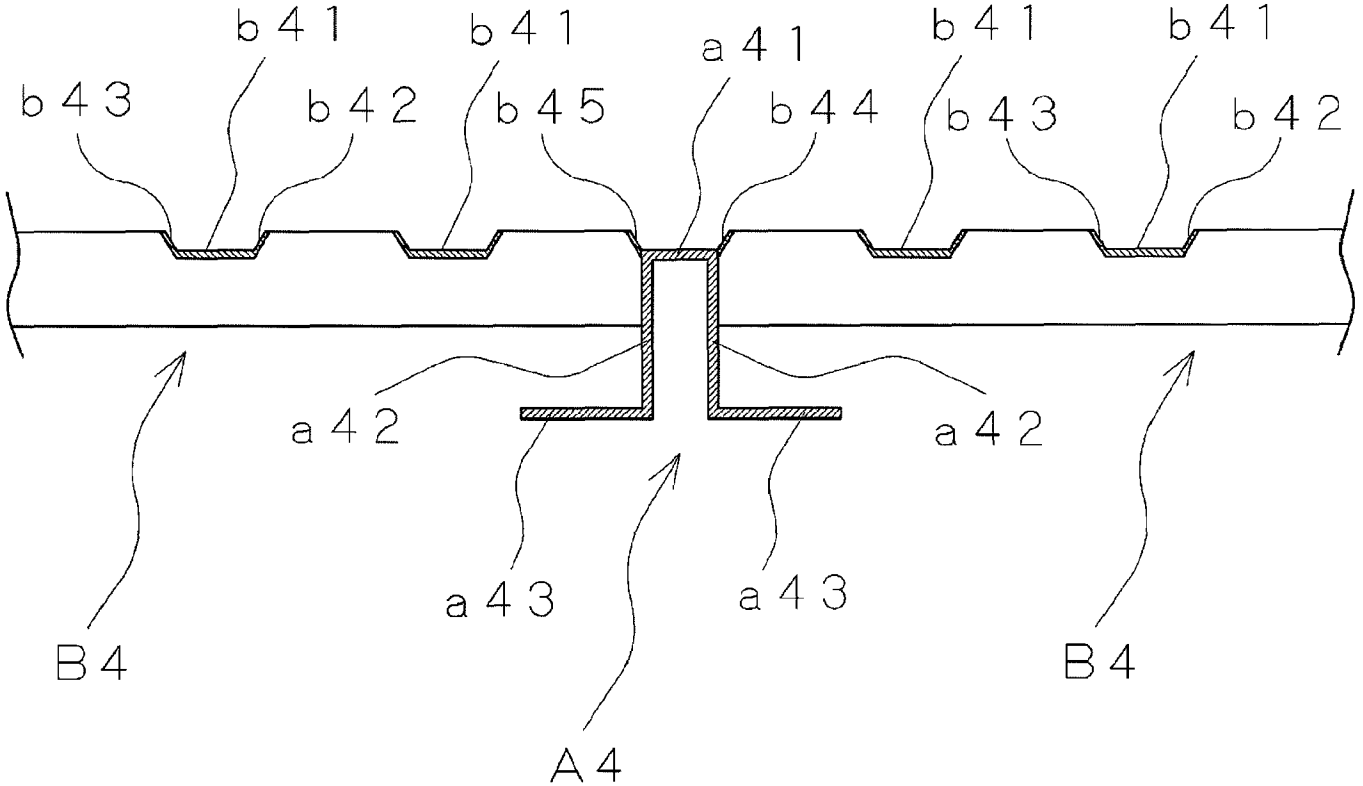
FIG. 6 is a diagram of yet another embodiment of the construction structure of wall surface according to the present invention, viewed from above.
Figure 7:
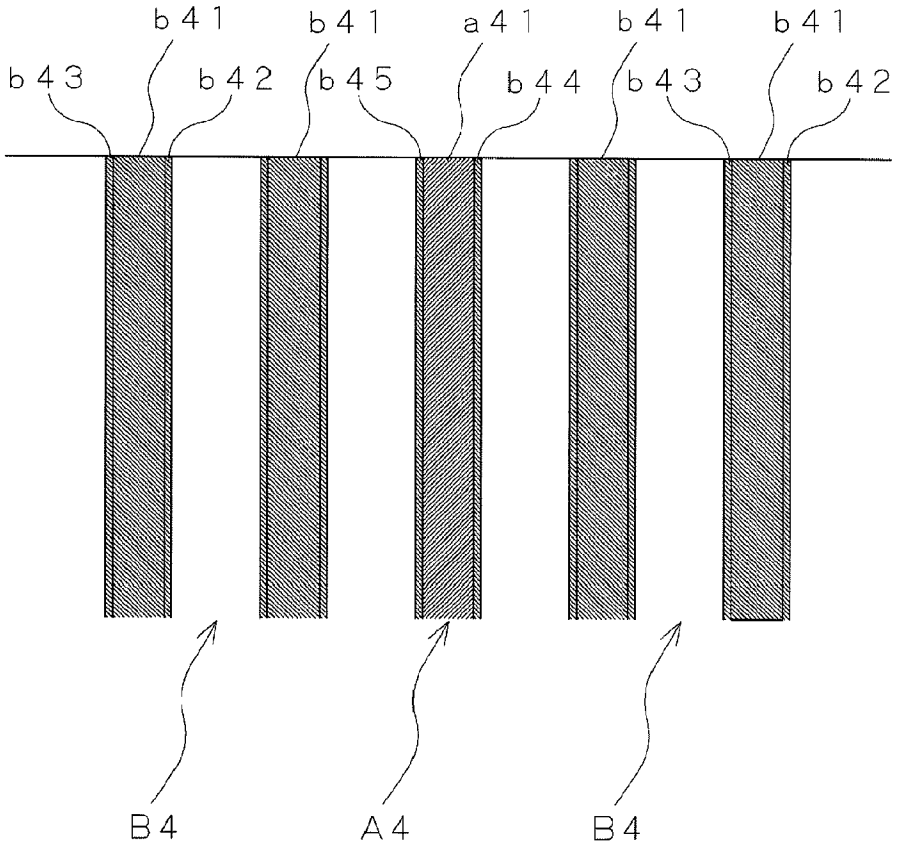
FIG. 7 is a diagram of the construction structure of wall surface illustrated in FIG. 6 viewed from the front.

FIGS. 6 and 7 are diagrams, viewed from above and from the front, of yet another embodiment of the construction structure of wall surface according to the present invention.

The construction structure of wall surface illustrated in FIGS. 6 and 7 comprises a hat joiner A4 and building boards B4. The hat joiner A4 is identical to the hat joiner A1 of FIG. 3, and comprises a design portion a41, connecting portions a42 and fixing plate portions a43. However, the building boards B4 are different from the building boards B1 of FIGS. 1 and 2 in that now the design portion is formed by recesses b41 and oblique portions b42, b43. The recesses b41 and oblique portions b42, b43 are provided as a plurality thereof in the surface of the building boards B4, so as to traverse vertically the board up and down. The horizontal width and the color of the recesses b41 are the same as the horizontal width of the design portion a41 of the hat joiner A4. Chamfer portions b44, b45 are provided at the left end and the right end of the surface of the building boards B4, so as to traverse vertically the board up and down. The horizontal width and color of the oblique portions b42, b43 are the same as the horizontal width and color of the chamfer portions b44, b45. In the construction structure of wall surface illustrated in FIGS. 6 and 7, the positions of the surface of the building boards B4 and of the hat joiner A4 are different from those in the construction structure of wall surface illustrated in FIGS. 1 and 2. In the construction structure of wall surface illustrated in FIGS. 6 and 7, the height of the surface of the design portion a41 of the hat joiner A4 is the same as the height of the surface of the recesses b41 of the building boards B4, B4. As a result, the joining portion between the building boards B4, B4 is hardly noticeable also in the construction structure of wall surface. In this construction structure of wall surface as well, the horizontal width of the recesses b41 is the same as the horizontal width of the design portion a41 of the hat joiner A4. The horizontal width and color of the oblique portions b42, b43 are the same as the horizontal width and color of the chamfer portions b44, b45. Therefore, the mutual joints cannot be readily distinguished, and the joining portion between building boards B4, B4 is inconspicuous. Since no sealing material is present at the joining portion between the building boards B4, B4, there occurs no deterioration of the sealing material over time. This renders unnecessary repairs or renewal. Also, breakage becomes less likely by providing the chamfer portions b44, b45 at the left end and the right end of the surface of the building boards B4.

Figure 8:
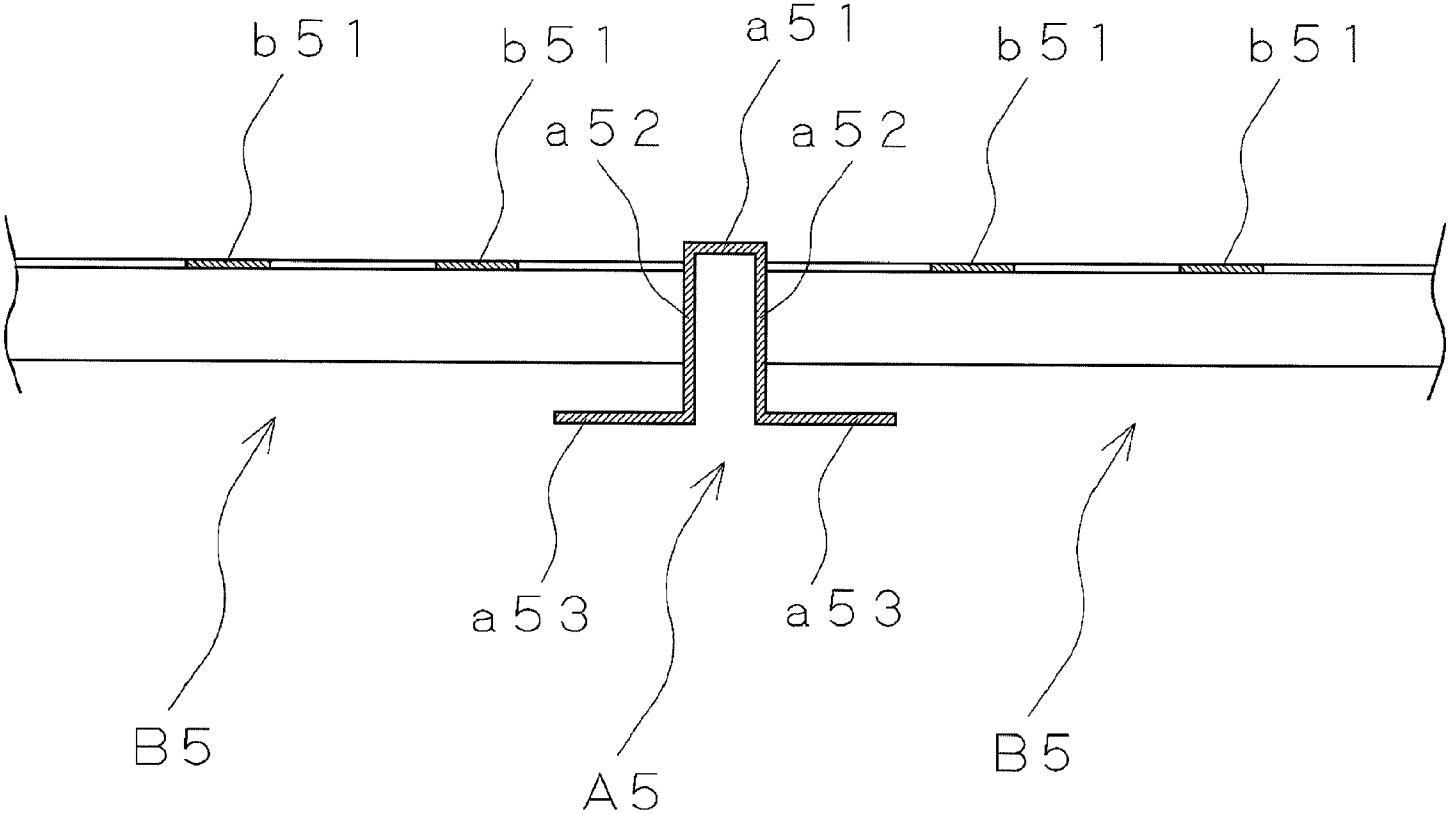
FIG. 8 is a diagram of yet another embodiment of the construction structure of wall surface according to the present invention, viewed from above.

FIG. 8 is a diagram of yet another embodiment of the construction structure of wall surface according to the present invention, viewed from above.

The construction structure of wall surface illustrated in FIG. 8 comprises a hat joiner A5 and building boards B5. The hat joiner A5 is identical to the hat joiner A1 of FIG. 3, and comprises a design portion a51, connecting portions a52 and fixing plate portions a53. The building boards B5 are identical to the building boards B1 illustrated in FIGS. 1 and 2, and have a plurality of coating films b51, as a design portion, on the surface. In the construction structure of wall surface illustrated in FIG. 8, however, the positions of the surface of the building boards B5 and of the hat joiner A5 are different from those in the construction structure of wall surface illustrated in FIGS. 1 and 2. In the construction structure of wall surface illustrated in FIG. 8, the position of the design portion a51 of the hat joiner A5 is higher than the surface of the building boards B5, B5. However, the horizontal width and color of the coating films b51 in the present the construction structure of wall surface are the same as the horizontal width and color of the design portion a51 of the hat joiner A5, and the coating films b51 are parallel to the design portion a51. Therefore, the mutual joints cannot be readily distinguished, and the joining portion between building boards B5, B5 is inconspicuous. Since no sealing material is present at the joining portion between the building boards B5, B5, there occurs no deterioration of the sealing material over time. This renders unnecessary repairs or renewal. The position of the design portion a51 of the hat joiner A5 is higher than the surface of the building boards B5, B5, and hence any unevenness that may occur between the building boards B5, B5 becomes inconspicuous.

Figure 9:
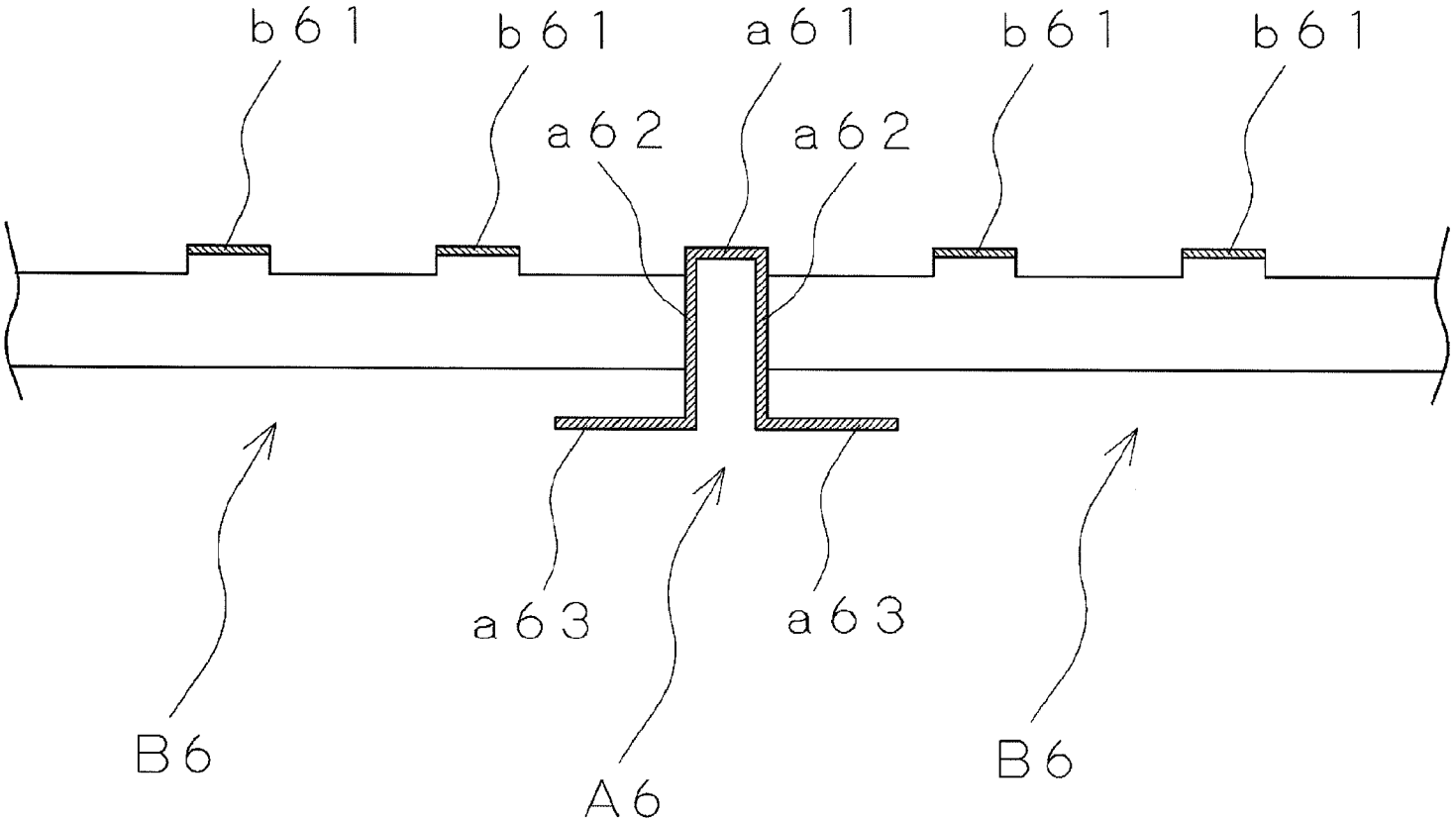
FIG. 9 is a diagram of yet another embodiment of the construction structure of wall surface according to the present invention, viewed from above.

FIG. 9 is a diagram of yet another embodiment of the construction structure of wall surface according to the present invention, viewed from above.

The construction structure of wall surface illustrated in FIG. 9 comprises a hat joiner A6 and building boards B6. The hat joiner A6 is identical to the hat joiner A1 of FIG. 3, and comprises a design portion a61, connecting portions a62 and fixing plate portions a63. However, the building boards B6 are different from the building boards B1 of FIGS. 1 and 2 in that now the design portion is formed by projections b61. The projections b61 are provided as a plurality thereof in the surface of the building boards B6, so as to traverse vertically the board up and down. The horizontal width of the projections b61 is the same as the horizontal width of the design portion a61 of the hat joiner A6. A coating of the same color as that of the design portion a61 is applied onto the surface of the projections b61. In the construction structure of wall surface illustrated in FIG. 9, the positions of the surface of the building boards B6 and of the hat joiner A6 are different from those in the construction structure of wall surface illustrated in FIGS. 1 and 2. In the construction structure of wall surface illustrated in FIG. 9, the height of the surface of the design portion a61 of the hat joiner A6 is the same as the height of the surface of the projections b61 of the building boards B6, B6. As a result, the joining portion between the building boards B6, B6 is hardly noticeable also in the construction structure of wall surface illustrated in FIG. 9. In this construction structure of wall surface as well, the horizontal width and color of the projections b61 are the same as the horizontal width and color of the design portion a61 of the hat joiner A6. Therefore, the mutual joints cannot be readily distinguished, and the joining portion between building boards B6, B6 is inconspicuous. Since no sealing material is present at the joining portion between the building boards B6, B6, there occurs no deterioration of the sealing material over time. This renders unnecessary repairs or renewal.

Figure 10:
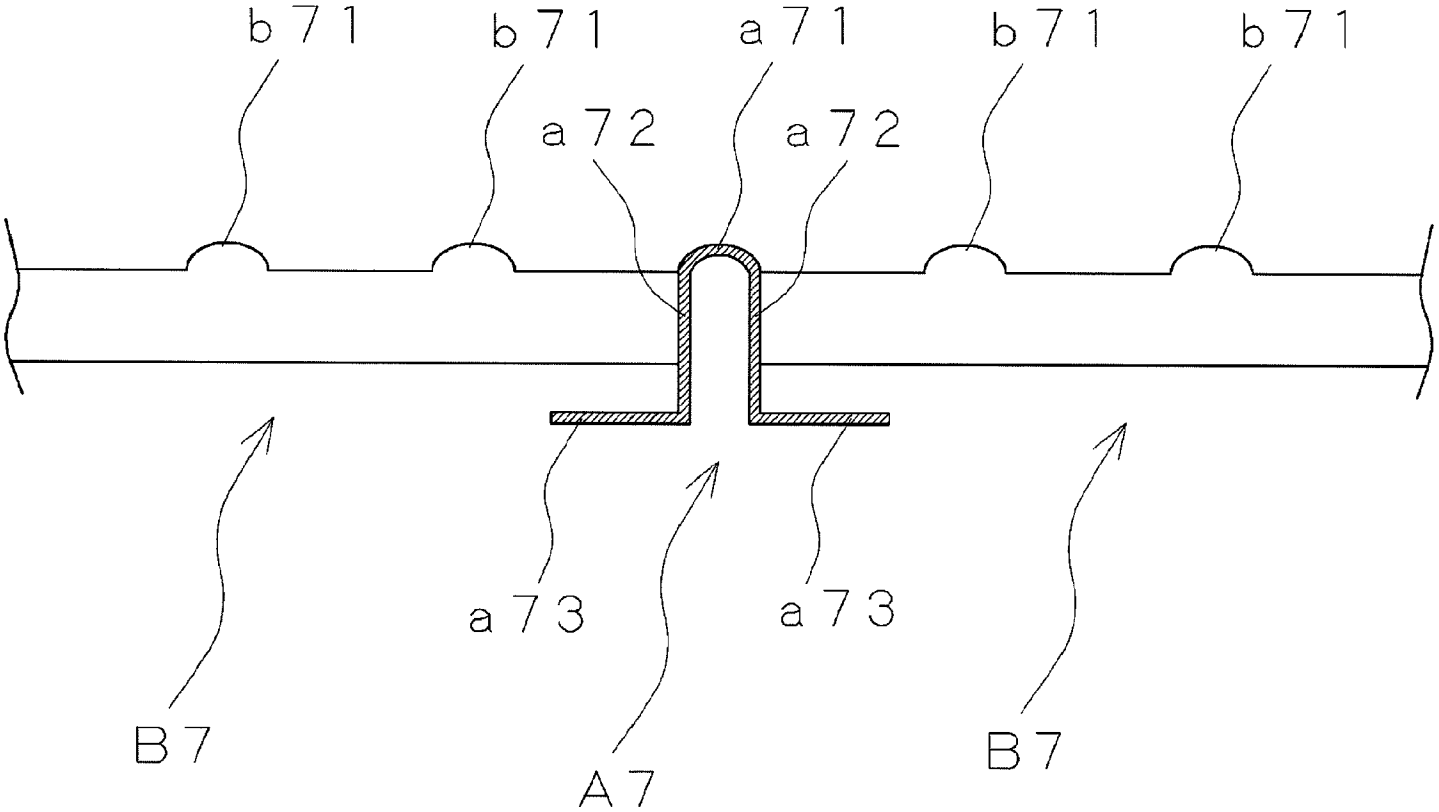
FIG. 10 is a diagram of yet another embodiment of the construction structure of wall surface according to the present invention, viewed from above.

FIG. 10 is a diagram of yet another embodiment of the construction structure of wall surface according to the present invention, viewed from above.

The construction structure of wall surface illustrated in FIG. 10 comprises a hat joiner A7 and building boards B7. The hat joiner A7 comprises a design portion a71, connecting portions a72 and fixing plate portions a73, but differs from the hat joiner A1 of FIG. 3 in that the design portion a71 is formed to have a cross section shaped as a circular arc. The building boards B7 are also different from the building boards B1 of FIGS. 1 and 2 in that now the design portion is formed by projections b71. The projections b71 are provided as a plurality thereof in the surface of the building boards B7, so as to traverse vertically the board up and down. The horizontal width of the projections b71 is the same as the horizontal width of the design portion a71 of the hat joiner A7. In the construction structure of wall surface illustrated in FIG. 10, the positions of the hat joiner A7 and of the surface of the building boards B7 are different from those in the construction structure of wall surface illustrated in FIGS. 1 and 2. In the construction structure of wall surface illustrated in FIG. 10, the height of the top section of the surface of the design portion a71 of the hat joiner A7 is identical to the height of the top section of the projections b71 of the building boards B7, B7. As a result, the joining portion between the building boards B7, B7 is hardly noticeable also in the construction structure of wall surface illustrated in FIG. 10. In this construction structure of wall surface as well, the horizontal width of the projections b71 is the same as the horizontal width of the design portion a71 of the hat joiner A7. Therefore, the mutual joints cannot be readily distinguished, and the joining portion between building boards 37, B7 is inconspicuous. Since no sealing material is present at the joining portion between the building boards B7, B7, there occurs no deterioration of the sealing material over time. This renders unnecessary repairs or renewal.

Figure 11:
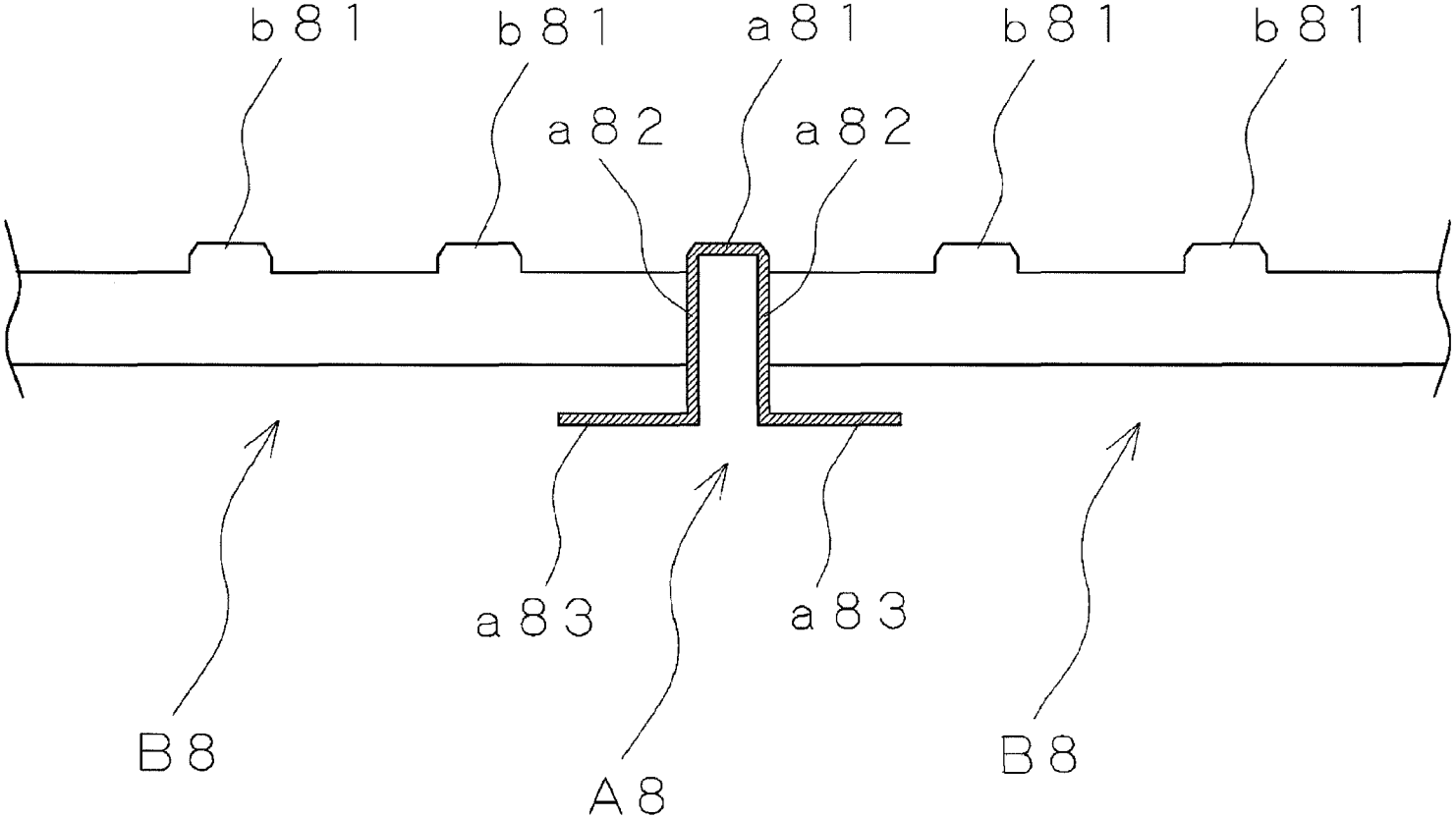
FIG. 11 is a diagram of yet another embodiment of the construction structure of wall surface according to the present invention, viewed from above.

FIG. 11 is a diagram of yet another embodiment of the construction structure of wall surface according to the present invention, viewed from above.

The construction structure of wall surface illustrated in FIG. 11 comprises a hat joiner A8 and building boards B8. The hat joiner A8 comprises a design portion a81, connecting portions a82 and fixing plate portions a83, but differs from the hat joiner A1 of FIG. 3 in that the design portion a81 has an oblique portion at the left and right ends. The building boards B8 are also different from the building boards B1 of FIGS. 1 and 2 in that now the design portion is formed by projections b81. The projections b81 are provided as a plurality thereof in the surface of the building boards B8, so as to traverse vertically the board up and down. The horizontal width of the projections b81 is the same as the horizontal width of the design portion a81 of the hat joiner A8. Like the design portion a81, the projections b81 have each an oblique portion at the left and right ends. In the construction structure of wall surface illustrated in FIG. 11, the positions of the surface of the building boards B8 and of the hat joiner A8 are different from those in the construction structure of wall surface illustrated in FIGS. 1 and 2. In the construction structure of wall surface illustrated in FIG. 11, the height of the top section of the surface of the design portion a81 of the hat joiner A8 is identical to the height of the top section of the projections b81 of the building boards B8, B8. As a result, the joining portion between the building boards B8, B8 is hardly noticeable also in the construction structure of wall surface illustrated in FIG. 11. In this construction structure of wall surface as well, the horizontal width of the projections b81 is the same as the horizontal width of the design portion a81 of the hat joiner A8. Therefore, the mutual joints cannot be readily distinguished, and the joining portion between building boards B8, B8 is inconspicuous. Since no sealing material is present at the joining portion between the building boards B8, B8, there occurs no deterioration of the sealing material over time. This renders unnecessary repairs or renewal.

Embodiments of the present invention have been explained above, but the present invention is not limited thereto, and can accommodate various modifications without departing from the scope of the invention as set forth in the appended claims. For instance, in FIGS. 1 to 11, the joint by the design portion of the hat joiner, as well as and the design portions on the surface of the building boards, are all provided in the form of vertical joints, but may also be provided in the form of horizontal joints As described above, the present invention allows providing a construction structure of wall surface having no sealing material and in which joining portions between building boards are inconspicuous.

What is claimed is:

1. A construction structure of wall surface, comprising:

a hat joiner having a fixing plate portion and a top surface portion; and a plurality of building boards each having a design portion extending linearly on a front surface, wherein the hat joiner is disposed between the building boards so that the building boards abut the hat joiner, the building boards and the hat joiner are disposed so that i) the design portion extending linearly on the front surface of the building boards is parallel to a direction in which the top surface portion of the hat joiner extends and ii) the top surface portion of the hat joiner constitutes an external appearance of the construction structure in combination with the front surface of the building boards, a width of the top surface portion of the hat joiner is a same as a width of each said design portion extending linearly on the front surface of each of the building boards, each said building board has projection portions and recess portions on the front surface, at least one projection portion being located at an end portion of the building boards, the projection portions or the recess portions form the design portion extending linearly on the front surface of each said building board, an upper corner of each of the projection portions of the building boards is chamfered so that each chamfered corner of the projection portion has an identical shape and the building boards have a chamfered end at the end portion, each of the recess portions forms the design portion of the building boards, and the building boards and the hat joiner are disposed so that i) the chamfered end of the building boards abut the hat joiner, ii) the recess portions forming the design portion of the building boards extend linearly and parallel to the direction in which the top surface portion of the hat joiner extends, and iii) the top surface portion of the hat joiner and the chamfered ends of the building boards in combination forms a same shape as the recess portion of the building boards, and the construction structure of wall surface does not have a sealing material.

2. The construction structure of wall surface, according to claim 1, wherein the top surface portion of the hat joiner and the design portion extending linearly on the front surface of the building board have a same color.

3. The construction structure of wall surface according to claim 1 or 2, wherein the top surface portion of the hat joiner is disposed higher than the front surfaces of adjacent said building boards.

4. The construction structure of wall surface according to claim 1 or 2, wherein the top surface portion of the hat joiner is disposed lower than the front surfaces of adjacent said building boards.

5. The construction structure of wall surface according to claim 1 or 2, wherein the top surface portion of the hat joiner is disposed flush at a same height as the front surfaces of adjacent said building boards.

6. The construction structure of wall surface according to claim 1 or 2, wherein the design portions extending linearly on the front surface of the building boards are formed by coating.

* * * * *